US007231874B2

(12) United States Patent
Rastegar et al.

(10) Patent No.: US 7,231,874 B2
(45) Date of Patent: Jun. 19, 2007

(54) POWER SUPPLIES FOR PROJECTILES AND OTHER DEVICES

(75) Inventors: Jahangir S. Rastegar, Stony Brook, NY (US); Thomas Spinelli, E. Northport, NY (US)

(73) Assignee: Omnitek Partners LLC, Bayshore, NY (US)

( * ) Notice: Subject to any disclaimer, the term of this patent is extended or adjusted under 35 U.S.C. 154(b) by 22 days.

(21) Appl. No.: 10/235,997

(22) Filed: Sep. 5, 2002

(65) Prior Publication Data

US 2003/0041767 A1 Mar. 6, 2003

Related U.S. Application Data

(60) Provisional application No. 60/317,308, filed on Sep. 5, 2001.

(51) Int. Cl.
*F42C 11/06* (2006.01)

(52) U.S. Cl. ..... 102/207; 102/209

(58) Field of Classification Search ..... 102/207, 102/208, 209, 210
See application file for complete search history.

(56) References Cited

U.S. PATENT DOCUMENTS 3,570,404 A * 3/1971 Pope ..... 102/70.2
3,781,575 A * 12/1973 Campagnuolo ..... 310/8.8
3,861,313 A * 1/1975 Campagnuolo et al. ..... 102/70.2 G
3,863,571 A * 2/1975 Campagnuolo et al. ..... 102/81
3,961,577 A * 6/1976 O'Steen ..... 102/70.2 G
4,005,319 A * 1/1977 Nilsson et al. ..... 310/8.3
4,372,211 A * 2/1983 Dante ..... 102/207
4,421,029 A * 12/1983 Wich ..... 102/207
4,637,311 A * 1/1987 Rehmann ..... 102/209
4,656,943 A * 4/1987 Edminster ..... 102/208
4,964,593 A * 10/1990 Kranz ..... 244/3.24
5,101,728 A * 4/1992 Frink ..... 102/209
5,115,742 A * 5/1992 Frazer ..... 102/208
5,271,328 A * 12/1993 Boulais et al. ..... 102/207
5,487,957 A * 1/1996 Gourdine ..... 429/49
5,942,718 A * 8/1999 Falquete et al. ..... 102/207
5,988,080 A * 11/1999 Miyoshi et al. ..... 110/343
6,037,536 A * 3/2000 Fraas ..... 136/253

OTHER PUBLICATIONS

How the Seiko Kinetic Works.*
Seiko- A Brief History.*

* cited by examiner

*Primary Examiner*—Timothy D. Collins

(57) ABSTRACT

A method for generating power in a device is provided. The method includes: generating power from an inherent characteristic of the device; and supplying the generated power to at least one power consuming element associated with the device. Preferably, the inherent characteristic of the device is an acceleration of the device and the generating includes providing a mass which is movable upon the acceleration of the device and converting a potential energy of the mass into an electrical power. Alternatively, the inherent characteristic of the device is a heat generation on at least a portion of the device and the generating includes converting a heat from the heat generation into an electrical power. In another alternative, the inherent characteristic of the device is a spinning of the device and the generating includes converting the spinning of the device into an electrical power.

7 Claims, 7 Drawing Sheets

POWER SUPPLIES FOR PROJECTILES AND OTHER DEVICES

CROSS-REFERENCE TO RELATED APPLICATION

This application claims priority to earlier filed U.S. provisional application, Ser. No. 60/317,308 filed on Sep. 5, 2001, the entire contents of which is incorporated herein by its reference.

BACKGROUND OF THE INVENTION

1. Field of the Invention

The present invention relates generally to power supplies, and more particularly, to power supplies for projectiles, which generate power due to an inherent characteristic of the projectile, such as its acceleration, spin, and/or heat generation.

2. Prior Art

All existing and future smart and guided projectiles and those with means of one-way or two-way communications with a command or tracking station or with each other require electric power for their operation. In addition, as munitions are equipped with the means of communicating their type and characteristics with the firing system to ensure that the intended round is being used and for fire control purposes, and for health monitoring and diagnostics runs before loading, they would require a low level of power supply minutes and sometimes even seconds before being loaded into the gun system. The amount of power required for the proper operation of such smart and guided munitions or those equipped with the aforementioned health monitoring and diagnostics capabilities, is dependent on their mode of operation and the on-board devices that have to be powered. The amount of power requirement is fairly small if the projectile is required to only receive a RF or other similar signal and to power sensors such as MEMs types of accelerometers and rate gyros or health monitoring and diagnostics related electronics. The power requirement is increased if the projectile is also required to communicate back to the ground or some mobile station. The power requirement, however, becomes significant when the projectile has to be equipped with electric or smart materials based actuation devices for guidance and control, particularly if the projectile is required to become highly maneuverable over long traveling times and while traveling at relatively high speeds such as supersonic speeds.

The wide range of power requirements, operating conditions and environmental, safety and reliability issues and shelf life requirements clearly indicates that no single power generation method and device can be appropriate and may be optimally designed for all current and perceived future applications. This means that different power generation concepts have to be sought that could be optimally designed for different smart and guided munitions such as medium caliber gun launched interceptors that travel at supersonic speeds and are required to be guided and highly maneuverable during their flight. As a result, a number of novel power generation concepts that are based on different existing technologies are presented in this proposal.

SUMMARY OF THE INVENTION

An objective of the methods and devices of the present invention is the development of power generation devices for use on various guided and smart munitions. Depending on each specific application, one or a combination of such power generation devices can be utilized for optimal performance and minimal space and weight requirements.

Thus, a primary objective of the present invention is to provide novel methods and devices for electric power generation that can be readily integrated into the structure of the projectile with minimal or no loss of the intended functionality of the structure. As a result, all or a significant portion of the space required to house an equivalent power source can be saved. In addition, the power generation devices and their related components are better protected against high acceleration loads, vibration, impact loading, repeated loading and acceleration and deceleration cycles that can be experienced during transportation and loading operations.

The main characteristics of the electric power generation devices provided herein include:

- A first class of power generators "fueled" by an inherent characteristic of a device, such as the potential energy extracted from the projectile during the firing, or as a result of the spin or heat generation.
- The power generators are primarily integrated into the structure of the projectile as load bearing members to minimize the space requirements.
- As load-bearing members, structurally integrated power generators would add minimal weight to the entire system.
- Capable of surviving gun firing loads of in excess of 100,000 g due to their integration into the structure of the projectile.
- Capable of withstanding high vibration and impact and repeated loads due to their integration into the structure of the projectile.
- Capable of covering a wide range of power requirements, from very low power requirements to large power with high discharge rates.
- The electric power generators of the present invention are readily scaled up and down for integration into a wide range of projectiles such as small, medium and large caliber gun fired munitions as well as mortars and even rockets. The electric power generators of the present invention further have utility in commercial devices.
- Eliminate or minimize wiring requirements since the electronic, communications, sensory devices and many of the guidance and control actuation devices may be directly mounted on the structure of the projectile at the power generation site.

Accordingly, a device is provided which comprises: at least one power consuming element, and a power supply which generates power from an inherent characteristic of the device and supplies such power to the at least one power consuming element.

Preferably, the device is a projectile and the inherent characteristic is the acceleration of the projectile. Alternatively, the device is a projectile and the inherent characteristic is the heat of the projectile. In another alternative, the device is a projectile and the inherent characteristic is the spin of the projectile.

Also provided is a method for producing electricity from a heat generating device. The method comprising: providing an electricity conversion means for converting heat to electrical power; placing the electricity conversion means in an area of the heat generating device where heat is generated; converting said heat to electrical power; and providing said power to a power consuming device. Preferably, the heat generating device is a power generation plant, the area is one of an incinerator or smokestack, and the power consuming device is an electrical grid. Alternatively, the heat generating device is a fireplace, the area is a firebox or flue, and the power consuming device is an electrical grid or battery storage.

Still yet provided is a method for generating power in a device. The method comprising: generating power from an inherent characteristic of the device; and supplying the generated power to at least one power consuming element associated with the device.

Preferably, the inherent characteristic of the device is an acceleration of the device and wherein the generating comprises providing a mass which is movable upon the acceleration of the device and converting a potential energy of the mass into an electrical power.

Alternatively, the inherent characteristic of the device is a heat generation on at least a portion of the device and wherein the generating comprises converting a heat from the heat generation into an electrical power.

In another alternative, the inherent characteristic of the device is a spinning of the device and wherein the generating comprises converting the spinning of the device into an electrical power.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The methods and devices for power generation that utilize the available geometry of the projectiles and other devices and are essentially integrated into the structure of the projectile or other device will now be described in detail. The proposed devices, their various components, their general mode of operation, and their general characteristics are described. The devices are divided into two major categories. The first category includes those concepts in which the energy is derived primarily from the potential energy stored in certain medium or elements during the firing as the projectile is accelerated in a gun barrel. The second category includes those devices that utilize thermophotovoltaic materials, which are integrated into the structure of the projectile or other devices, on appropriate surfaces as relatively thin layers where they are used to convert radiated heat to electrical energy.

Figure 1:
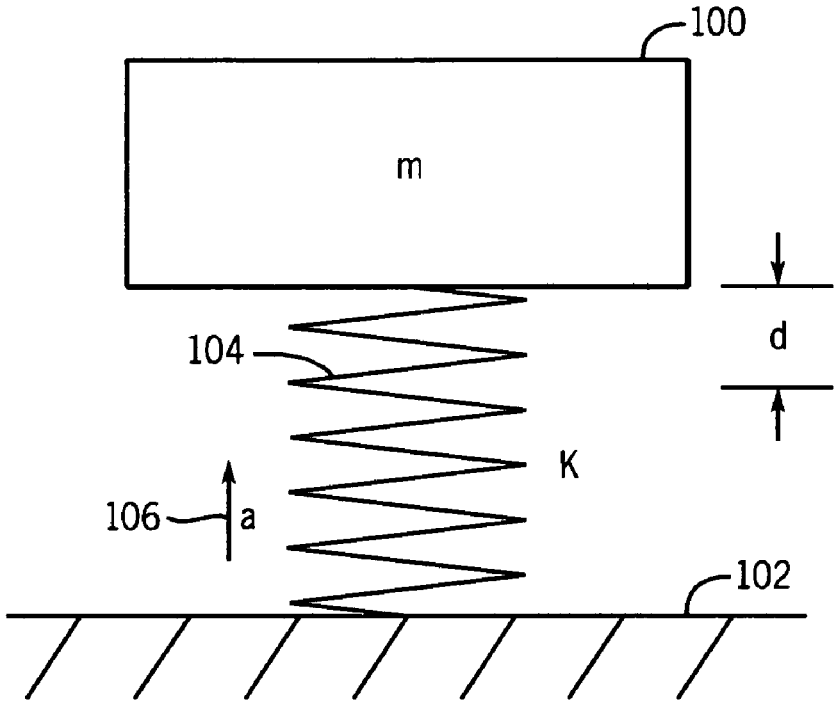
FIG. 1 illustrates a schematic representation of a power generating device of the present invention having a linear spring.

Consider an object 100 having a mass m attached to a moving platform 102 by a spring 104 having a spring constant k as shown schematically in FIG. 1. The object 100 will be referred to hereinafter as a mass m. The moving platform can be any device or portion thereof, which undergoes an acceleration. If the moving platform 102 is accelerated in the direction of arrow 106 by an acceleration a, assuming instantaneous application of the acceleration and that the spring 104 is stiff and long enough, then the spring 104 will be compressed by the mass 100 a distance d as shown in FIG. 1. The amount of spring compression d must obviously be enough to balance the resulting force being exerted on the spring by the accelerating mass 100, i.e., if the force being exerted by the mass 100 on the spring 104 is F, then the following relationships must hold.

$$F=ma \tag{1}$$

$$F=kd \tag{2}$$

The potential energy, $P_E$, stored in the compressed spring is then given by the following relationship:

$$P_E=(½)kd^2=(½)Fd=(½)mad \tag{3}$$

As an example, if a mass m=0.1 kg is accelerated to a=20,000 g (i.e., 20,000×9.8 M/s$^2$) in a projectile, and if the spring rate is selected such that the spring deflects a distance d=0.025 m (about 1 inch), then the potential energy stored in the spring k would be:

$$P_E=(0.5)(0.1)(20{,}000\times 9.8)(0.025)=245\ N\text{-}m$$

This means that if the above potential energy were converted to electricity in its entirety, then 245 N-m (Joules) of energy would become available. Assuming 30 percent efficiency for converting the above potential energy into the electrical energy, then about 74 J of potential energy would be converted into electricity. If the time of flight is t=5 sec, assuming that the aforementioned energy conversion can be accomplished during the same amount of time, then the amount of electric power, w, that becomes available to the onboard electrical components becomes:

$$w=74/5=14.8\ \text{watts}$$

The amount of power that can be reasonably be generated using the above method is obviously more than enough for powering the communications, sensory and guidance electronics, and actuation devices that are efficient and do not consume excessive amounts of power, particularly those that utilize the dynamics and the aerodynamics of the flight to amplify the actuator generated guidance and control forces.

The power generation devices and methods in the first category are based on converting the above potential energy into electrical energy. Various preferred devices and methods for converting such potential energy will now be described. In summary, different types of potential energy storage springs 104 may be used in place of the illustrated helical spring, such as torsional, bending or other similar type of springs. Alternatively, certain flexibility in the structure of the projectile may be utilized to convert such potential energy. Alternatively, the compression of certain gas or a mixture of fluid and gas may be used to convert the potential energy into electrical power. Also, the mass 100 may be distributed over a certain part of the structure of the projectile or other device, which also has certain relative flexibility. Furthermore, several preferred means for converting the stored potential energy into the electric energy are provided. The power generation concepts presented in this section all utilize some type of mechanical spring element to extract and store potential energy from the firing acceleration. In all these concepts, an inertial element provides a preloading force or torque on the spring element, which is generated by the acceleration of the projectile within the gun barrel.

The schematic of FIG. 1 describes the basic elements of the power generation devices utilizing the platform acceleration induced preloading of the spring 104 (generally elastic) elements. In general, the spring 100 may be any type of elastic element, e.g., a helical spring, a torsional spring, a beam element providing bending flexibility, or flexibility provided by the structure of the device.

A first preferred way of converting the potential energy of the mass due to an acceleration of the device is through a vibrating inertia power generator. The vibrating inertia power generators have a common characteristic, which is the vibration mode of converting the stored potential energy in spring elements into electrical energy. In all such devices, the energy storage springs or members are preloaded during the firing as described above. In terms of a projectile, once the projectile has exited the barrel, i.e., once the preloading acceleration is ceased, then the inertia element begins to vibrate relative to the structure of the projectile. In fact, the structural flexibility indicated by the spring element 100 may be due to the flexibility in the mass element 100 itself. The preferred embodiment of this design is a device constructed with one or more beam elements as shown in FIGS. 2 and 3.

Figure 2:
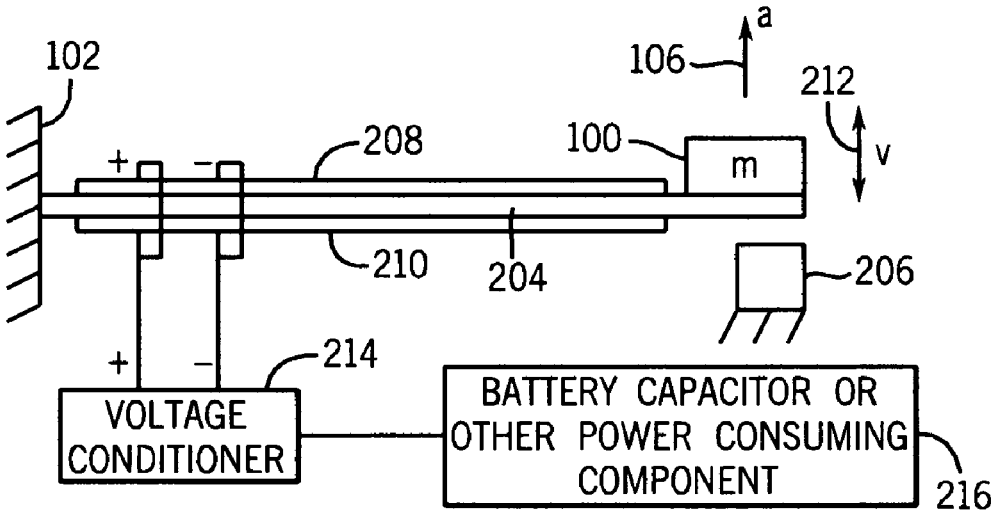
FIG. 2 illustrates a power-generating device having a flat flexible beam member and piezo films attached thereto for converting a vibration of the beam member into electrical power.

In FIG. 2, the device is shown to be constructed with one cantilever beam element 204, which is subjected to flexural deformation (bending during the application of the acceleration 106 of the moving platform 102. A further end mass 100 may be added to increase the total deflection of the beam 204 when needed. In general, when the platform 102 acceleration could be large, a stop 206 may be provided to limit the maximum beam deflection. For such devices, the preferred means of electric energy generation is piezo bimorph films 208, 210 that are mounted on the top and bottom surfaces, respectively, of the beam 204. Once the platform 102 acceleration has terminated, the potential energy stored in the beam element 204 due to its flexural (bending) deformation causes the beam element to vibrate v in the direction of arrow 212 in its bending mode(s). As a result, when the beam is bent downwards, the upper piezo film 208 is subjected to tensile and the lower film 210 is subjected to compressive stresses. During each cycle of the beam 204 vibration v, the above stresses change direction from being in tensile to becoming compressive and vice versa. As a result, the piezo films provide a varying voltage that can be harvested. The voltage is preferably conditioned by a voltage conditioner 214 to output a DC voltage and used to charge a capacitor and/or a rechargeable battery, or directly used to power an electrical load (all of which are collectively referred to herein as a power consuming component 216). In the remaining implementations, the voltage conditioned and power consuming components are omitted for the sake of brevity, however, such are assumed in all implementations.

Figure 3:
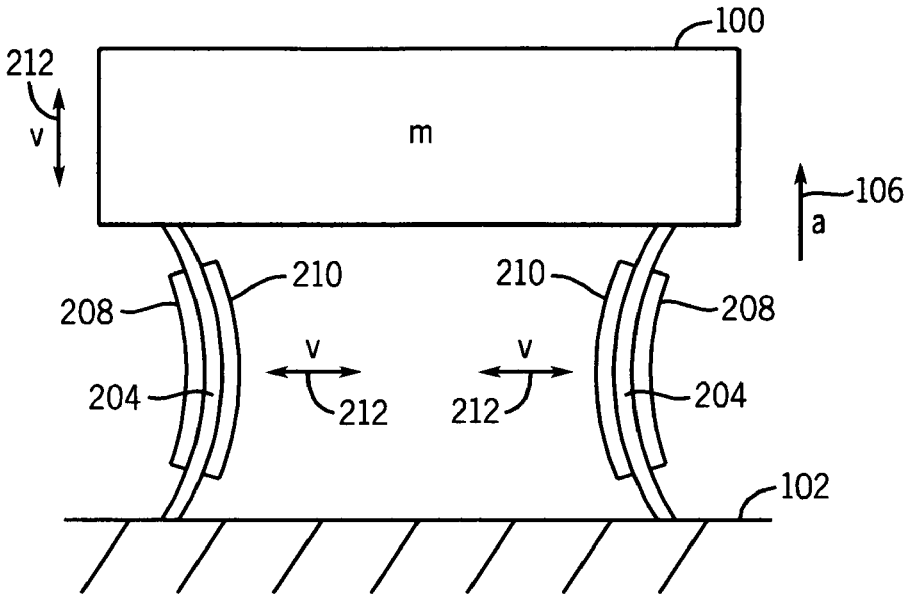
FIG. 3 illustrates a power-generating device having curved flexible beam members and piezo films attached thereto for converting a vibration of the beam member into electrical power for converting a vibration of the beam member into electrical power.

Another configuration for a vibration induced power generation is shown in FIG. 3. In the configuration of FIG. 3, the beam elements 204 are curved and are used in a column type of configuration and are directed in the direction of the platform 102 acceleration. The column-like beams 204 are curved so that they could be flexible in the axial direction to vibrate in the direction of arrow v 212. The acceleration of the moving platform 102 causes the base mass 100 to move down relative to the moving platform, tending to curve the beams 204 inward. Once the moving platform 102 acceleration has ceased, the potential energy stored in the beam elements 204 causes them to vibrate. Electrical energy is then generated by the piezo films 208, 210 as described for the device of FIG. 2. Alternatively, the mass 100 can tend to straighten out the beams 204 during the acceleration of the moving platform 102.

Figure 4:
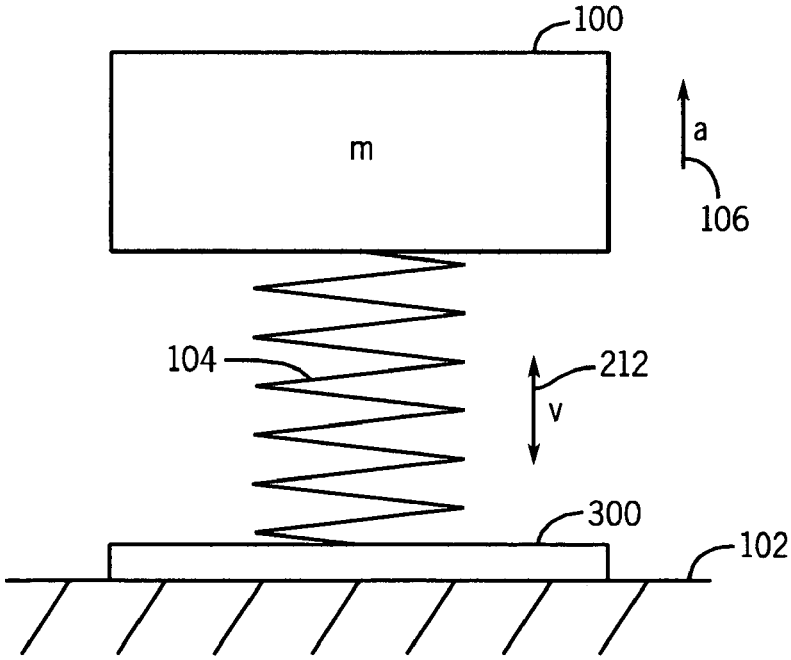
FIG. 4 illustrates the power generating device of FIG. 1 having a piezo stack for converting a vibration of the linear spring into electrical power.

Referring now to FIG. 4, there is shown another embodiment of the present invention, in which the power generation device is constructed with one or more vibration spring elements, similar to that shown schematically shown in FIG. 1. However, although one spring 104 is shown, a plurality or an array of springs is preferred to provide stability for the mass 100 and eliminate the need for bushings or slides to constrain the motion of the mass 100. The spring element 104 is then connected to the moving platform 102 via a piezo-stack element 300. In the device shown in FIG. 4, the mass 100 is directly attached to a helical spring element 100 with spring rate k which is attached to the moving platform 102 via the piezo stack element 300. During the acceleration of the moving platform 102, the spring 104 is compressed or extended depending on the direction of the acceleration. The potential energy stored in the spring element 104 will then result in the mass-spring 100/104 combination to vibrate as the acceleration has ceased or has varied. As a result, during each cycle of vibration, the spring 104 applies a varying cycle of compressive and tensile force on the piezo stack 300, thereby causing the piezo stack 300 to generate a cycle of varying voltage and charge which can be harvested by an appropriate electronic circuitry to charge a capacitance and/or a rechargeable battery or be directly be used to power an electric load.

Figure 5:
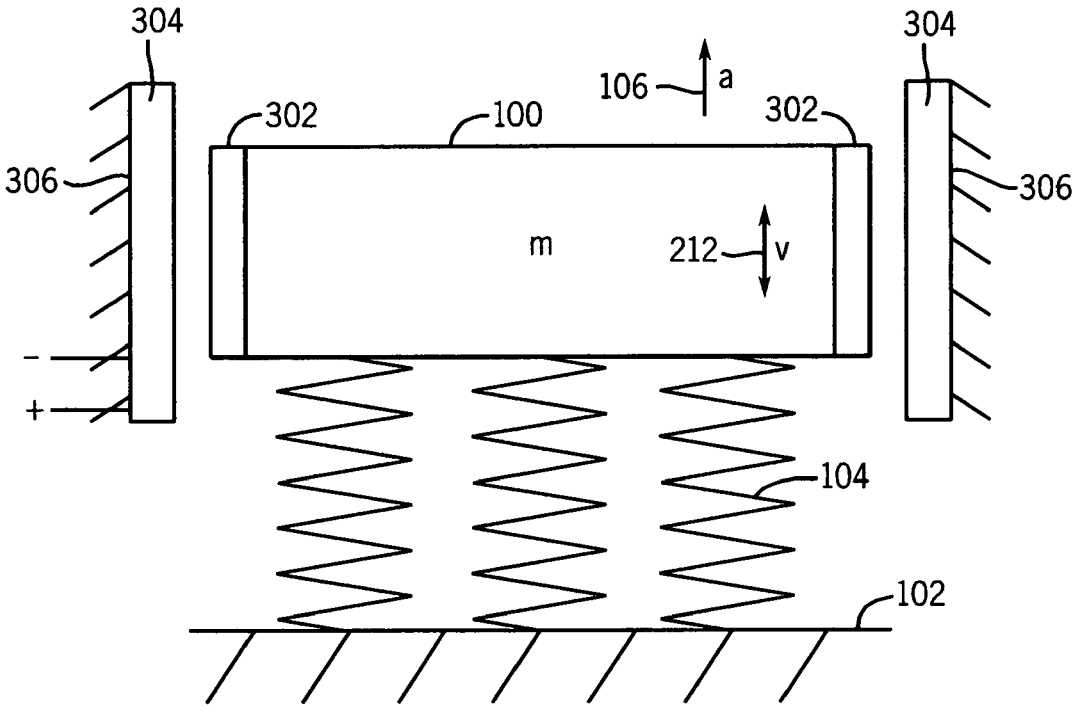
FIG. 5 illustrates the power generating device of FIG. 1 having a coil and magnet generator for converting a vibration of the linear springs into electrical power.

In another implementation of the present invention, magnet and coil elements are used instead of the aforementioned piezo stacks to convert the potential energy to power as shown in FIG. 5. Although FIG. 5 illustrates the elastic member as springs 104, deformable beams similar to those illustrated in FIGS. 2 and 3 can also be used. In the device of FIG. 5, the mass is deflected a distance d by the acceleration 106 of the moving platform 102 and after such acceleration decreases, the mass/spring system 100/104 vibrate in the direction of arrow v 212. Electrical energy can then be generated by driving a coil and magnet generator. In such generators, the vibrating mass 102 preferably is or contains the magnet 302 and the coil 304 is stationary relative to the coil 304. Where the device is a projectile, the coil 304 is preferably printed on the opposite surfaces onto the projectile walls 306.

Figure 14:
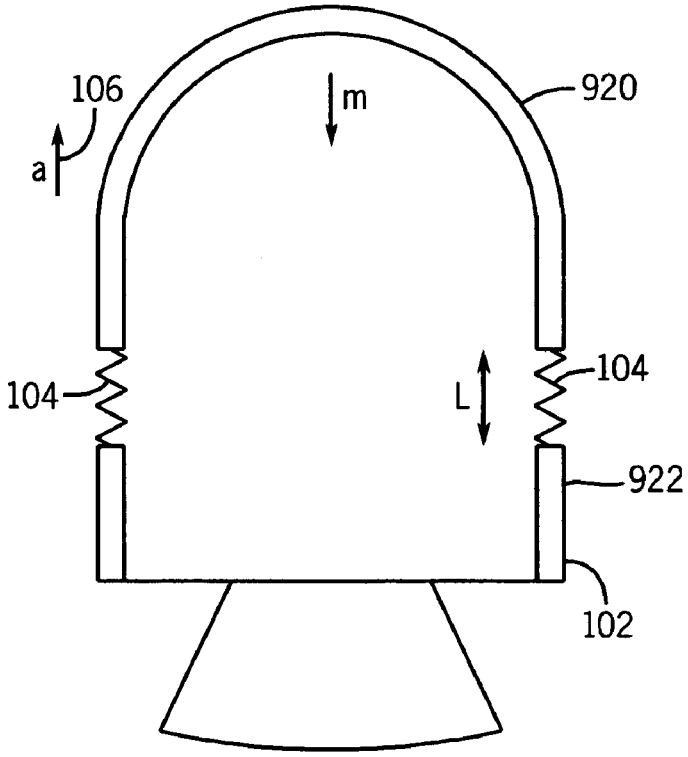
FIG. 14 illustrates a projectile having the configuration of the power generating device of FIG. 1 integrated into the casing walls thereof.

In the schematic Figures provided herein, the inertia elements are shown to be positioned within the projectile or other device and near its longitudinal axis. In practice, the location of the inertia element must be determined from the available space and is preferably close and even within the projectile shell or device casing. The optimal space saving is achieved when the spring element is part of the structure of the projectile shell or device casing and divides the projectile or device casing into two halves 920, 922 as illustrated in FIG. 14, and the inertia element is one of the halves 920 which is displaced longitudinally (for linear springs,104 that act in the longitudinal direction L) and rotationally about the longitudinal axis (for torsional type of springs that act about the longitudinal axis).

The linear spring elements described above are preloaded directly by the acceleration of the moving platform, such as during the firing of a projectile. However, torsional springs can also be used and are preloaded from a spinning of the device, such as during the firing acceleration of a projectile if the barrel is rifled to spin the projectile, or in the absence of any rifling (or in addition to the rifling acceleration), inclined and retractable wedges that are positioned around the inertia wheel are used to provide the rotational acceleration.

Figure 6:
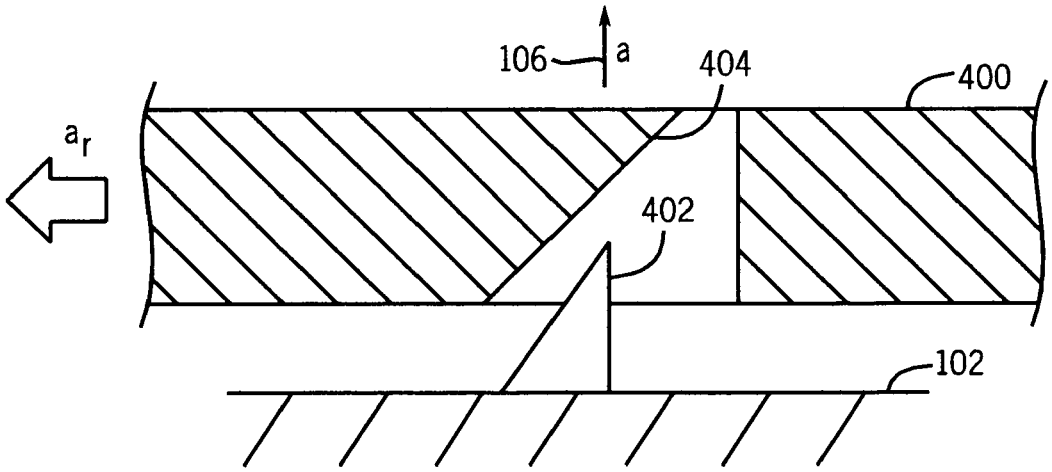
FIG. 6 illustrates a power generating device having an inertial wheel torsional spring for converting a vibration of the torsional spring into electrical power.

Such a device is shown in FIG. 6. In the device of FIG. 6, as the moving platform 102 is accelerated in the direction of arrow a 106, an inertia wheel 400 is pushed down towards the bottom surface of the moving platform 102. A torsional spring, positioned in the lateral plane, is provided with the desired flexibility in the longitudinal direction to allow the above downward movement of the inertia wheel 400. As the inertial wheel 400 is pushed downward, an inclined wedge 402 acts against an inclined surface 404 of the inertial wheel 400 and forces the inertial wheel 400 to gain a rotational acceleration $a_r$ about its longitudinal axis as shown in FIG. 6. In the case of a projectile, as the projectile exits from the barrel, since the torsional spring lifts the inertia wheel 400 up to its natural position, thereby disengaging it from the inclined wedge 402, allowing the torsional spring to unwind from its preloaded configuration. The inclined wedge retraction mechanism may be a simple breakage and bending away (down) of the wedge support as the maximum preloading torque is achieved or may be the result of the first impact with the inertia wheel, noting that the inertial wheel 400 almost entirely clears the wedge 402 as it returns up to its natural position. The inertia wheel 400 and the torsional spring system would then begin to undergo rotational vibration and generate electrical energy, such as by energizing a coil with a moving magnet on the inertial wheel 400 similar to that described in FIG. 5.

In general, the linear spring member devices are preferred for a number of reasons. Firstly, the resulting system has fewer parts and is less complex. More importantly, however, the longitudinal vibration of the vibrating mass, m, would also cause the projectile to vibrate in the same direction. This is the case since as the mass, m, of the power generation mechanism vibrates longitudinally, since the projectile is airborne, it would also undergo a synchronous vibration in the opposite direction. The latter vibration amplitudes are, however, smaller since the projectile is much more massive than the vibrating mass. Similar vibration occurs for the rotating spring member, but in rotation about the longitudinal axis. If sensors determining the position or orientation of the projectile rely on the orientation of the fins or the body of the projectile, then the rotational vibration of the projectile may not be desired since it may reduce the accuracy of such sensory devices. In addition, rotational vibration of the fins and the projectile could increase drag on the projectile.

Figure 7:
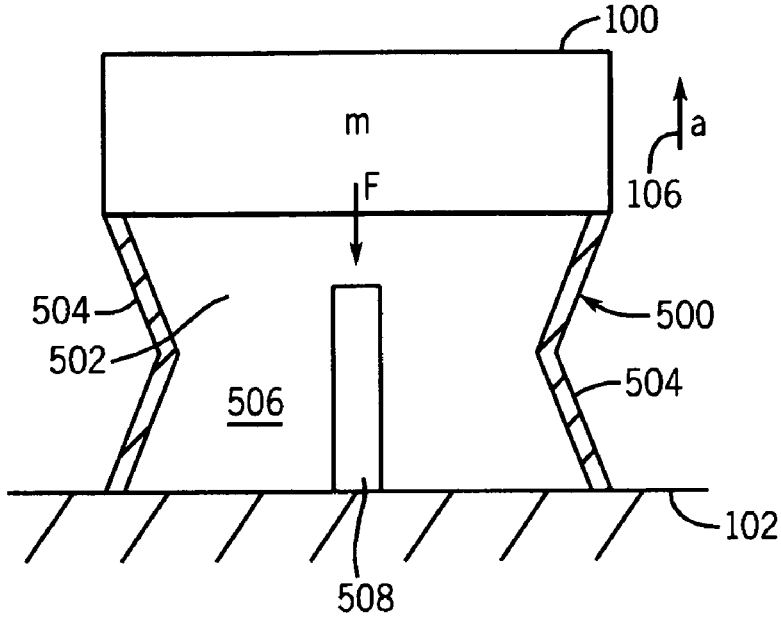
FIG. 7 illustrates a power generating device having a collapsible chamber for generating electrical power from compression of a gas and/or liquid in the chamber.

In another type of power generation device, the mass is used to compress a gas and/or gas and fluid mixture and power is generated therefrom. A characteristic common to these devices is that the firing acceleration is used to compress a gas or a mixture of a gas and a fluid, which is used to generate electric power following the projectile exit from the gun barrel. FIG. 7 illustrates a power generation device having a gas or gas and fluid mixed chamber 500. The chamber may be sealed or may have a relatively small, orifice size, outlet. The gas 502 filling the chamber may be air or a combustible gas and/or fluid. The chamber 500 is located-within the projectile, even though it may be an integral part of its shell or support structure.

A mass 100 is positioned on the top of the chamber 500. During the firing, as the projectile is accelerated, the mass 100 exerts a force F=m a, where a is the acceleration of the projectile. The walls 504 of the chamber 500 are constructed such that they are prone to buckling, for example by giving then a curvature inward to the interior volume 506 of the chamber 500. By configuring the chamber walls 504 to collapse plastically in buckling under the above acceleration generated force F, the gas volume contained within the chamber 500 is brought under compression. The level of internal pressure that is achieved is dependent on the firing acceleration level, the strength of the collapsible walls 504, the amount of mass 100, and the shape and geometry of the collapsible walls 504. Optimal design of such collapsible containers in terms of the size, amount of mass 100, the level of pressure that can be achieved is preferably achieved by constructing the chamber walls in the form of structural elements disclosed in U.S. Pat. No. 6,054,197 to Rastegar, the contents of which are incorporated herein by its reference. In general, a stop 508 is provided to prevent the collapsible chamber 500 from being crushed beyond the desired limit.

Figure 9:
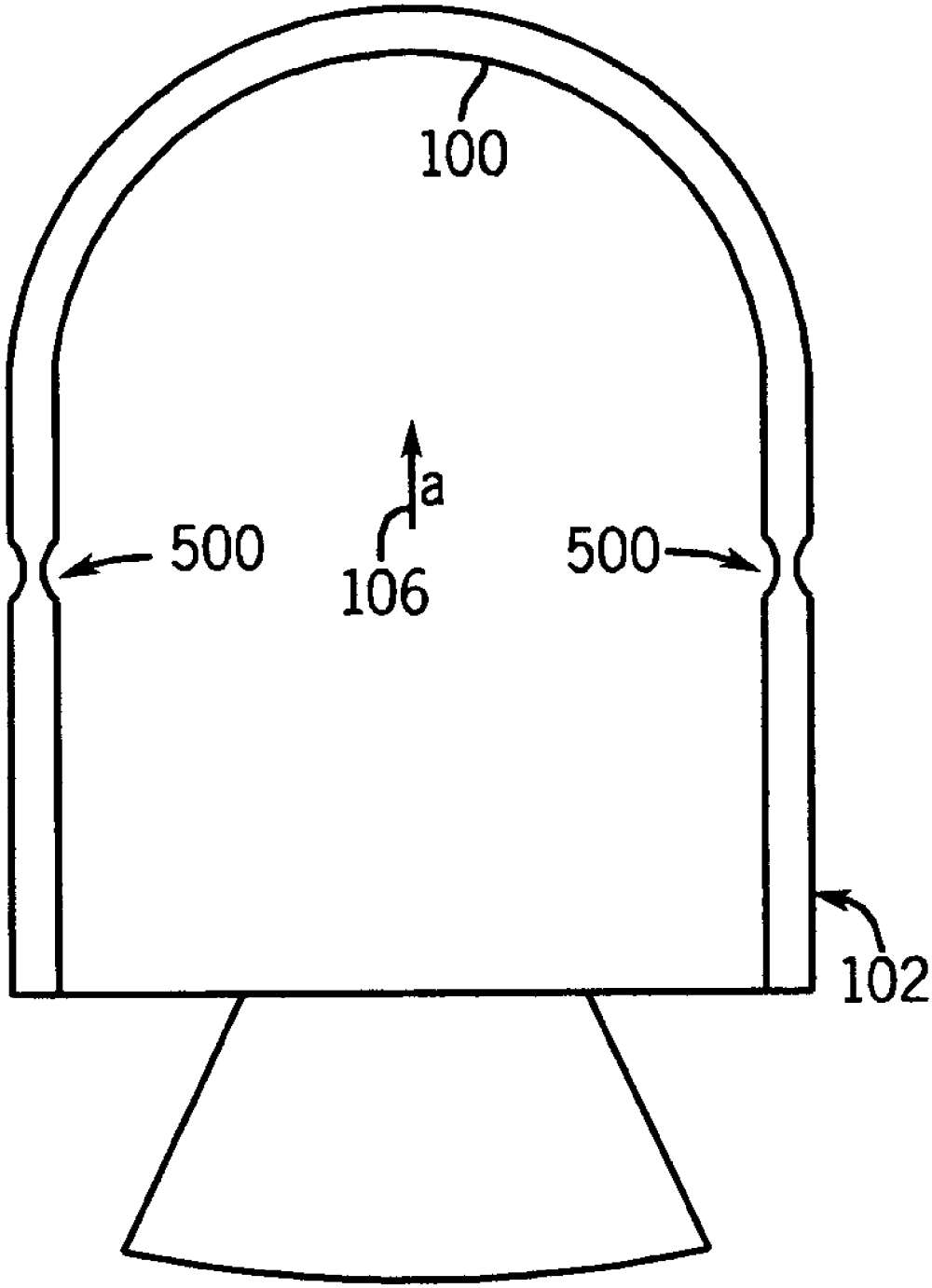
FIG. 9 illustrates a projectile having the configuration of the power generating device of FIG. 7 integrated into the casing walls thereof.

The collapsible chamber can be positioned within the projectile volume, however, in practice, and particularly for larger caliber projectiles such as mortars, the collapsible chamber may be built into the structure of the projectile, e.g., the shell of the projectile. In such designs, the chamber walls are designed to buckle towards the interior of the projectile volume and the mass of the front part 100 of the projectile would provide the desired "crushing" force during the acceleration of the projectile. Such a configuration is shown in FIG. 9.

Figure 8A:
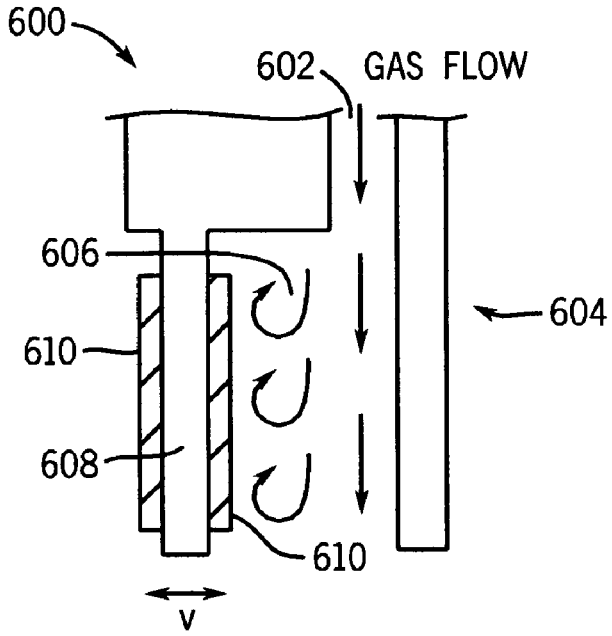
FIGS. 8A and 8B show alternative configurations for generating-the electrical power from the compressed gas and/or liquid in the device of FIG. 7.

Once the projectile has exited the gun barrel, the generated compressed gas or gas and fluid mixture can be used to generate electricity. Numerous methods may be used to generate electrical energy depending on the type of gas and or gas and fluid mixture used and the method of electrical power generation. One such way is by providing one or more piezo film resonators 600 as illustrated in FIG. 8A. In this configuration, the compressed gas is preferably air or some heavy but inert gas. The compressed gas is then exhausted from the chamber 500 through an orifice 602 and accelerated through a simple nozzle 604. The nozzle is preferably constructed to induce vortices 606 in the gas flow. The vortices induce a vibration of a member 608, the sides of which are constructed with a layer of piezo film 610 or other similar material. The member 608 is tuned to be resonated by the flowing gas (like a whistle), thereby generating electrical power.

Figure 8B:
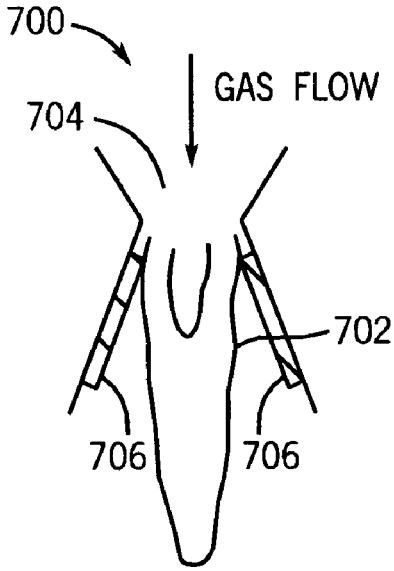

FIG. 8B illustrates another preferred implementation for generating power from the compressed gas or gas/fluid in the chamber 500, namely by burning of the exhausted gas or gas and fluid mixture through one or more nozzles 700. In this configuration, the compressed gas or the gas and fluid mixture from the chamber 500 is exhausted through one or more exhaust nozzles 702, and burned in a combustion chamber 704. Electrical energy is then generated by covering the internal surfaces of the combustion chamber 704 and/or the exhaust nozzle 702 with a layer of thermophotovoltaic materials 706. By achieving high enough temperatures, the thermophotovoltaic materials covered surfaces would absorb the radiated heat and convert it directly to electricity. Also, depending on the type of projectile, the exhaust gases can be used as base bleed to reduce drag and/or used to provide thrust to increase the range. The burned gases exiting the combustion chamber can alternatively be used to run an electrical energy-generating turbine (not shown). This configuration is most appropriate for long-range projectiles, particularly those that are to be used for surveillance or other similar missions.

The electrical power generation device provided above use firing acceleration to generate potential energy that is stored in the form of linear or torsional spring preloading, the build-up of gas or gas and fluid mixture pressure within sealed collapsible chambers. However, the above energy storage springs and beam members may obviously be preloaded before the projectile is fired and held in its preloaded position by simple wires or other similar means. The firing acceleration can then be used to snap the wire or otherwise to release the preloaded mass (inertia). In a similar manner, shape memory wires or small charges may be used to release the preloaded spring following firing. Compressed air or an inert gas may similarly be provided and release following firing. Combustible gases or gas and fluid mixtures may also be provided under pressure and released following firing.

Figure 10:
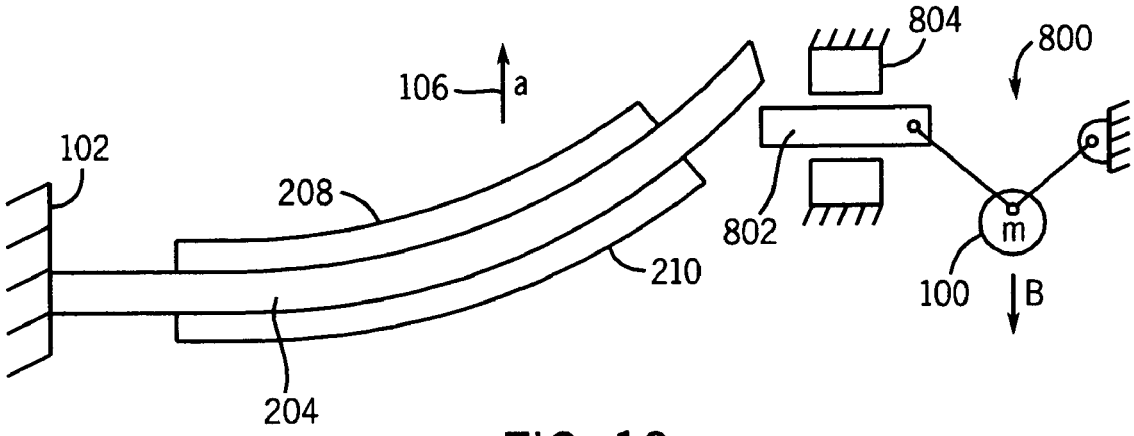
FIG. 10 illustrates a power generating device similar to that of FIG. 2 except for the beam member being preloaded a predetermined deflection.

FIG. 10 illustrates a preferred implementation of a preloaded configuration in which a beam member 204, similar to that illustrated in FIG. 2 is preloaded and released upon acceleration of the projectile or other moving platform 102. Upon acceleration 106 of the moving platform 102, mass 100 moves downward in the direction of arrow B which causes the linkage 800 to slide the stop bar 802 in the slides 804 and away from a blocking position of the beam member 204. After the stop bar 802 is slid away, the beam member 204 is free to vibrate as discussed previously with regard to FIG. 2 and to generate an electrical power as also previously discussed with regard to FIG. 2. The springs and collapsible chambers discussed previously can be preloaded in a similar manner.

Another method for generating power from an inherent characteristic of a device, such as a projectile is by structurally integrating thermophotovoltaic materials into the projectile or other device. Preferably, the power generation device is constructed as a layer of the composite skin of the shell or other appropriate surfaces of the projectile. Such power sources are readily formed over surfaces of various shape, are effectively load bearing, occupy minimal volume, add almost no additional weight, and can withstand very high acceleration and impact loads. In addition, the electric energy consuming components may be mounted directly on the projectile surface at or near the power generating layer, thereby eliminating any need for wiring and eliminating the related component hardening issues. Such power generation concepts using thermophotovoltaic materials and constructed as thin films and located on the "hot spots" of the projectile are provided below. The advantages of using thermophotovoltaic materials based power generators are also provided.

Thermophotovoltaic materials are capable of generating considerable amount of power within a high temperature region such as the nose of a very high-speed supersonic projectile or within the combustion chamber and/or the nozzle of rockets that used for range extension. The power source will have negligible effect on the performance of the rocket furnace and nozzle since it only absorbs radiated energy. As in the case of solar cells (photovoltaics), these materials convert energy of incident photons to electricity. In the case of thermophotovoltaics (TPV), for example gallium antimonide (GaSb), cells are tailored to use infrared energy to produce a potential difference and a current. The power source generator provided herein uses thermophotovoltaic materials constructed as a multi-layered cell and integrated into the structure of the shell over the nose or rocket combustion chamber or nozzle.

Over the last six to ten years, TPV cells have been tested under a variety of conditions. For example, those in the art have tested a heated SiC emitter with a GaSb infrared cell, which could produce 6 amps and 2.6W over a one square cm surface area. In this case, the SiC emitter was heated to 1500 C. They found that the range for IR response in these cells was well matched to the SiC emitter heated by hydrocarbon combustion. They also found that by changing the SiC configuration and using filters, a 30% efficiency of IR to DC power conversion could be achieved. Recently, some of the same authors have disclosed a small battery charging device based upon these principals, using high temperature SiC composites and various low bandgap photovoltaic cells. Shielded interconnects and a finned heat exchanger were also found to be necessary in the design. Others in the art have proposed using radioisotope decay to create heat to power TPV cells for spacecraft, claiming that a 25% power conversion efficiency could be achieved.

Recently, development of TPV devices has focused on creating appropriate spectrally selective emitter materials to match with GaSb and other low bandgap photocells. For example, still others in the art have used transition metal dopants (Co or Ni) in an IR-transparent MgO ceramic matrix. They found this material to provide high mechanical integrity, thermal shock resistance, excellent heat transfer and near-ideal spectral efficiency. Other low band gap TPV materials under consideration have included InGaAs/InP and InGaSbAs/GaSb with band gaps near 0.6-0.75 eV. Still yet other have apparently used large band gap (0.75-1.4 eV) TPV devices which use thermally stimulated rare earth oxides, such as erbium oxide, thulium oxide and holmium oxide.

In any case, the critical issues involve matching a proper band gap PV material with a corresponding IR emitter to optimize the device. In addition, the emitter must provide mechanical stability and excellent heat transfer as well as an appropriate spectral range. It has been reported recently that a commercial venture has developed a gas-fired heating stove that uses TPV cells, which generate as much as 5 $W/cm^2$ from a heating fuel gas flame. Hence, it appears to be possible that a large range of temperature, either from frictional generation at the tip of a shell or facing combustion at the range extending rockets, could produce DC electric power in the 1 watt or better range during the flight. In addition, since the speed or radiant heat conversion to electricity is extremely fast (unlike, for example, generators utilizing heat conduction, like all those thermocouple based electric power generators), such power generation devices are suitable for very high speed and short range gun fired projectiles.

Figure 11:
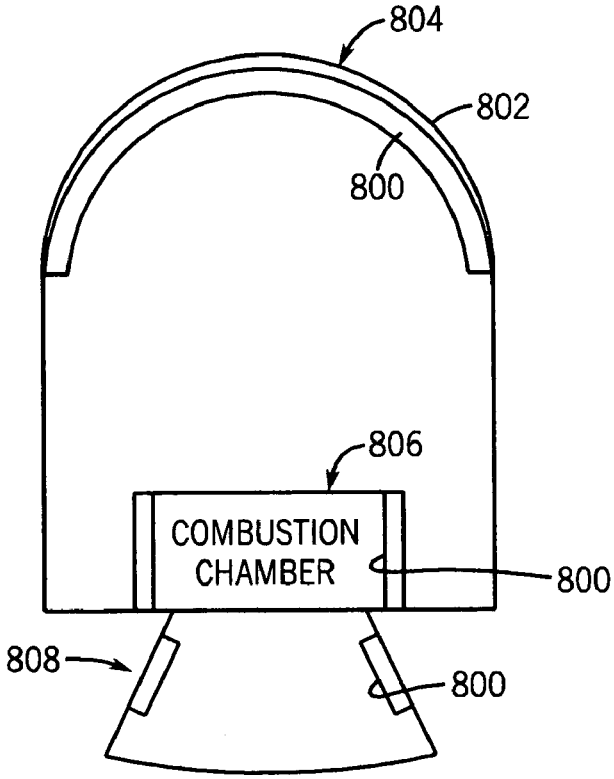
FIG. 11 illustrates a projectile having thermophotovoltaics integrated therein for producing electric power from heat generated by the projectile.

FIG. 11 shows a projectile having such a configuration. Preferably, the thermophotovoltaic materials 800 are constructed as a layer under the skin 802 at the desired surface location on the nose 804 of the projectile.

Preferably, the layers of thermophotovoltaic materials 800 based power generators are used in the construction of part or the entire surfaces that are subject to heating during the flight or during the firing. The candidate surfaces are the nose 804 of the projectiles that travel at supersonic speeds or within the combustion chamber 806 or nozzle 808 of range assist rockets. As a quick estimate of the amount of power that can be generated, consider the following scenario:

The estimated w=1 Watt per $cm^2$ can be achieved (this is 20 percent of what has been generated in the furnace of gas-fired home heating chambers discussed above, For a 40 mm medium caliber projectile, assume that a nose area with a diameter of 2 cm is covered with the power generating layer, Considering a near flat surface area to have been covered with the power generating area of 2 cm diameter (radius r=1 cm).

Then the amount of electrical power, p, that can be expected to be generated will be about:

$$p=\pi r^2 w=\pi 0.1^2 0.1=3.14 \text{ watts}$$

If the projectile is equipped with range increasing rockets, the combustion chamber and the exhaust nozzle surfaces can be covered with the proposed power generating layers of thermophotovoltaic materials. In such applications, since much higher surface temperatures are involved, significantly higher power generation densities, probably close to the w=5 W/$cm^2$ that have been achieved in gas-fired home water heaters should be easily achieved. For example, assuming that surfaces equivalent to a cylinder of 2.5 cm (r=1.25 cm) and length of L=5 cm has been covered, the amount of electrical power, p, that can be expected to be generated will be about:

$$p=\pi r^2 Lw=\pi(1.25)^2(5)(5)=122.7 \text{ watts}$$

Power generation devices that are based on thermophotovoltaic materials that absorb radiated heat generated during the firing, have essentially infinite life and are safe since they do not carry any charge before firing, i.e., during storage. Proper choice of materials and configuration would, however, be necessary to optimize the power source.

Figure 12:
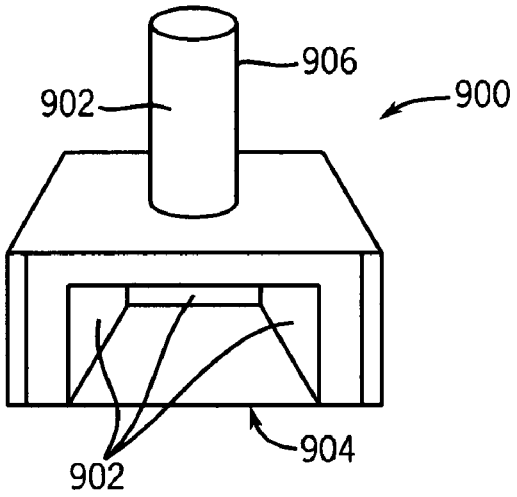
FIGS. 12 and 13 illustrate a fireplace and power plant, respectively, having thermophotovoltaics disposed therein for producing electric power from heat generated by the same.
Figure 13:
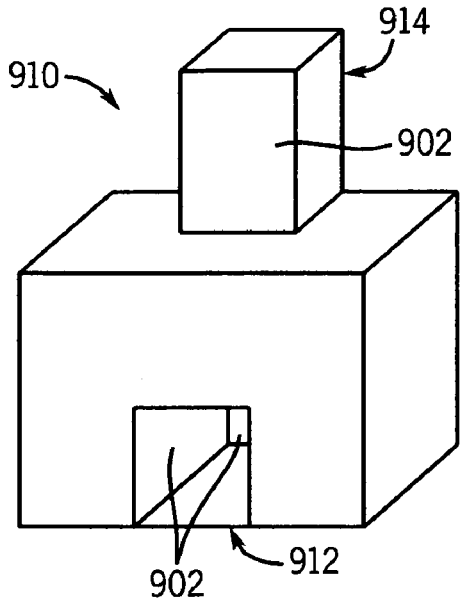

The thermophotovoltaic power generation devices described herein have numerous other applications. The most direct military application of the present concept is in missiles and rocket assisted mortars. Noting that the thermophotovoltaic materials have very high melting temperatures, in the order of ceramics and other similar materials, they can readily be employed on the surfaces of missile and rocket engine exhaust nozzles. Since the thermophotovoltaic materials based power generators only absorb the radiated heat to generate energy, their effect on the performance of rocket and missile engines is negligible since the radiated heat that is absorbed by the power generating surfaces would have mostly been radiated out of the nozzles rather than be absorbed by the flowing gasses. Similar commercial applications are also easy to find. An example includes fireplaces, particularly surfaces near the exhausts can be constructed with sheets of the proposed power generating materials. Power generators can also be made for campers to place around the camp-fire to charge the batteries of their camp lights, cell phone, flash lights and other electrical devices. There are also numerous industries that use furnaces, exhaust stacks, etc., that can utilize the present technology. FIGS. 12 and 13 illustrate a fireplace and power generation plant, respectively which utilize thermophotovoltaics to generate power.

In FIG. 12, the heat-generating device is a fireplace 900. The area where the thermophotovoltaic materials 902 are positioned are preferably the firebox 904 and/or the flue 906. The power generated is preferably an electrical grid or battery storage (not shown). In FIG. 13, the heat-generating device is a power generation plant 910, and the area where the thermophotovoltaic materials 902 are positioned are preferably the incinerator 912 and/or smokestack 914. The power generated is preferably supplied to an electrical grid.

Furthermore, an commercial market application for the power generation devices of the present invention is in automobiles, and in particular in hybrid Gas/electric vehicles. A hybrid vehicle is an automobile equipped with two or more sources of motive energy. More specifically, a hybrid car is defined as a vehicle that uses both a gasoline engine and an electric motor. For many years, automakers endeavored to develop ways to reduce the impact of vehicles on the environment by developing low-emission vehicles powered by alternatives to gasoline, such as electricity, natural gas and methanol. However, a number of obstacles have limited their success, notably the fact that they need to be refueled or recharged more frequently than conventional vehicles and the lack of facilities for doing so. Significant technological and infrastructure improvements are thus needed to ensure the viability of vehicles powered by alternative fuels—something that seems likely to take some time yet. In contrast, hybrid cars are viable for mass production because the fact that they generate their own electricity means that they only need to be refilled with gasoline periodically to enable continuous operability. There are two configurations for hybrid cars.

A hybrid car with a series configuration uses a gasoline engine to run a generator. The generator supplies electricity to the motor, which drives the wheels. The term series configuration reflects the fact that the motive power travels along a single path to the wheels. This allows the gasoline engine to run constantly while achieving optimum fuel efficiency, thereby minimizing emissions owing to incomplete combustion. A hybrid car with a parallel configuration uses both an engine and a motor to drive the wheels, depending on driving conditions. Under normal driving conditions, the gasoline engine is the primary source of power, while the electric motor is solely used at low speeds. The term parallel configuration derives from this side-by-side use of two power sources. Emission levels are reduced because the gasoline engine shuts off at low speeds—a time when internal-combustion engines generally output a large volume of emissions. An additional benefit of the parallel configuration is that no outside source of electric power is required because the engine itself generates the required electricity.

Currently, the only hybrid car on the market is a parallel-configuration vehicle. It is twice as fuel efficient as a conventional gasoline engine-powered car, while it emits only half the amount of CO2 and one-tenth the amount of other toxic substances. Even with environmental concern and protection growing as a priority at both the global and local levels there is resistance to hybrid cars. Most of this resistance stems from two distinct areas: 1) Hybrid car's overall accelerating performance vs. what many consider is "modest" improvements in fuel economy in urban settings and no improvements at high speeds. 2) Hybrid car's passenger and overall size limitations. As a result, new technology will be needed to increase the energy transference and generation from current hybrid designs.

The present invention can transform a simple shock absorber, combined with an energy storage device to generate supplemental energy for the hybrid car. In addition, the development and refinement of the thermal heart transference will allow the heat generated from ordinary brakes to also provide supplemental energy while causing a reduction in heat that will improve braking performance.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A munition comprising:

at least one power consuming element, and an electrical power supply which generates electrical power from a firing acceleration in an acceleration direction of the munition and supplies such electrical power to the at least one power consuming element;

wherein the power supply comprises means for storing potential energy upon the firing acceleration of the munition and means for converting the stored potential energy to electrical energy, wherein the means for storing potential energy includes a mass that is substantially movable in the acceleration direction;

wherein the means for storing potential energy upon the firing acceleration of the munition further comprises an energy storage means for storing energy upon acceleration of the mass and the energy storage means is a vibrating member, the vibrating member being acted upon by the mass to initiate a vibration of the vibrating member subsequent to the acceleration of the mass.

2. A method for generating electrical power in a munition, the method comprising:

generating electrical power from a firing acceleration in an acceleration direction of the munition; and supplying the generated electrical power to at least one power consuming element associated with the munition;

wherein the generating comprises providing a mass which is substantially movable in the acceleration direction upon the firing acceleration of the munition to preload at least one spring element and convening a stored potential energy in the at least one spring element into an electrical power where the converting comprises storing energy upon acceleration of the mass from a vibrating member, the vibrating member being acted upon by the mass to initiate a vibration of the vibrating member subsequent to the acceleration of the mass.

3. The munition of claim 1, wherein the energy storage means is at least one spring element, the at least one spring element being acted upon by the mass to displace the at least one spring element subsequent to acceleration of the mass.

4. The munition of claim 3, wherein the means for converting the stored potential energy to electrical energy comprises:

a magnet disposed on the mass; and a coil positioned at least partially around the mass for use with the mass to generate electrical energy.

5. The munition of claim 1, wherein the means for converting the stored potential energy to electrical energy comprises one or more piezo elements operatively associated to the vibrating member to generate electrical energy.

6. A munition comprising:

a casing;

a power consuming element associated with the casing; and means for storing potential energy within the casing at one of a firing acceleration of the munition and prior to the firing acceleration of the munition; and means for converting the stored potential energy to electrical energy which is at least partially and at least indirectly supplied to the power consuming element;

wherein the means for storing potential energy further comprises an energy storage means for storing energy upon acceleration of the mass and the energy storage means is a vibrating member, the vibrating member being acted upon by the mass to initiate a vibration of the vibrating member.

7. A method for generating power onboard a munition, the method comprising:

storing potential energy within a casing of the munition at one of a firing acceleration of the munition and prior to the firing acceleration of the munition;

converting the stored potential energy to electrical energy; and at least partially and at least indirectly supplying the electrical energy to a power consuming element;

where the converting comprises storing energy from a vibrating member, the vibrating member being acted upon by the mass to initiate a vibration of the vibrating member.

* * * * *